US005501001A

United States Patent [19]

Kamps

[11] Patent Number: 5,501,001

[45] Date of Patent: Mar. 26, 1996

[54] MACHINE FOR MOUNTING RIVETS, SNAPS AND THE LIKE

[75] Inventor: Rolf Kamps, Wuppertal, Germany

[73] Assignee: Stocko Verschlusstechnik GmbH & Co., Wuppertal, Germany

[21] Appl. No.: 404,647

[22] Filed: Mar. 15, 1995

[30] Foreign Application Priority Data

Mar. 15, 1994 [DE] Germany ..... 44 08 691.1

[51] Int. Cl.[6] ..... B23P 19/04; A41H 37/10

[52] U.S. Cl. ..... 29/788; 29/798; 227/15; 227/18

[58] Field of Search ..... 29/788, 798; 227/15, 227/16, 17, 18, 131, 149

[56] References Cited

U.S. PATENT DOCUMENTS

| | | | |
|---|---|---|---|
| 1,373,500 | 4/1921 | Glass | 227/18 |
| 2,559,278 | 7/1951 | Catlin et al. | 29/788 X |
| 3,069,688 | 12/1962 | Heil | 227/18 |
| 5,048,741 | 9/1991 | Toishi et al. | 227/18 |

FOREIGN PATENT DOCUMENTS

| | | | |
|---|---|---|---|
| 4225264 | 7/1993 | Germany . | |
| 366508 | 7/1957 | Switzerland . | |
| 368581 | 3/1932 | United Kingdom | 227/15 |

*Primary Examiner*—Peter Vo
*Assistant Examiner*—Khan V. Nguyen
*Attorney, Agent, or Firm*—Robert W. Becker & Associates

[57] ABSTRACT

A device for mounting parts has an upper tool with an upper stamp and a lower tool with a lower stamp. A drive unit for driving the upper and lower tools is provided. A feeding device for feeding parts to the upper and lower tools is present. A gear arrangement connects the upper and lower tools to the drive unit such that the upper and lower tools are movable in a reciprocating manner toward one another. The gear arrangement has an eccentric disk and a drive lever connected to the eccentric disk. A rocker arm is provided having a swivel axis about which the rocker arm swivels. The rocker arm pivotably connected with a first end to the drive lever and with a second end to the lower tool. A control rod is connected to the rocker arm and the drive lever, wherein a plurality of points of attachment are provided for the control rod.

6 Claims, 1 Drawing Sheet

MACHINE FOR MOUNTING RIVETS, SNAPS AND THE LIKE

BACKGROUND OF THE INVENTION

The present invention relates to a machine for mounting rivets, snap closures, etc., comprising an upper tool having an upper stamp, a lower tool with a lower stamp, a drive, and a feeding device whereby the upper and lower stamps are connected with a gear arrangement with a drive and are movable in a reciprocating manner toward one another whereby the lifting control for the lower stamp is realized with a lever controlled by an eccentric disk.

Such machines for mounting rivets, snap closures, patent fasteners, etc. are known per Such a machine is, for example, disclosed German Offenlegungsschrift 42 25 264 in which, however, the lower stamp is not driven and thus does not perform a compensating movement. Disregarding the fact whether the lower stamp is driven or not, the machines of the prior art do not provide for an adjustment of the lifting force and do not take into consideration material strengths or thicknesses. For example, for greater material thicknesses a stroke compensation is required as well as a force adjustment.

It is therefore an object of the present invention to improve a machine of the aforementioned kind such that different material thicknesses can be machined with a uniform processing quality.

SUMMARY OF THE INVENTION

A device for mounting parts according to the present invention is primarily characterized by:

An upper tool with an upper stamp;

A lower tool with a lower stamp;

A drive unit for driving the upper and the lower tools;

A feeding device for feeding parts to the upper and lower tools;

A gear arrangement for connecting the upper and lower tools to the drive units such that the upper and lower tools are movable in a reciprocating manner toward one another; and The gear arrangement comprising:

a) an eccentric disk;

b) a drive lever connected to the eccentric disk;

c) a rocker arm having a swivel axis about which the rocker arm swivels;

d) the rocker arm pivotably connected with a first end to the drive lever and with a second end to the lower tool; and e) a control rod connected to the rocker arm and the drive lever, wherein a plurality of points of attachment are provided for the control rod.

Advantageously, the attachment points are formed by bores provided at the drive lever. In an alternative embodiment, the attachment points are formed by an elongate guide slot at the drive lever. Preferably, adjacent to the guide slot an adjusting scale is located.

Preferably, the control rod has an adjustable length. Advantageously, the control rod comprises a threaded rod and a threaded adjusting sleeve engaging the threaded rod.

According to the present invention it is suggested that the lever for driving the lower tool, respectively, lower stamp is in the form of a rocker arm which swivels about a swivel axis and is connected pivotably to a drive lever whereby furthermore a control rod is provided that connected to the drive lever and the rocker arm. A plurality of alternative attachment points for the control rod is provided.

Due to the inventive embodiment of the control lever for the lower stamp it is possible, by varying the points of attachment for the control rod, to realize, on the one hand, stroke compensation and, on the other hand, to provide for variability of the leverage in order to provide force compensation.

In an advantageous manner it is suggested that the alternative points of attachment are the form of a row of bores provided at the drive lever. With this measure the control rod can be adjusted with respect to the point of action of the force at the drive lever so that a force adjustment is realized.

In the alternative it is suggested that the attachment points are in the form of a guide slot shaped as a slotted hole within the drive lever. This allows for a continuous adjustability of the attachment of the control rod at the drive lever. In an advantageous manner the guide slot has positioned adjacent thereto an adjusting scale.

For realizing a stroke adjustment it suggested that the control rod is adjustable with respect to its length. According to one suggestion of the present invention, this is realized by providing the control rod in the form of a threaded rod having attached thereto a threaded adjusting sleeve. Depending on the depth of penetration of the threaded rod into the threaded sleeve, the length of the control rod and thus the leverage can be varied.

The invention is not limited to the concrete realization presented in the preferred embodiment. For example, instead of a control rod it is also possible to use a connecting plate etc. Furthermore, it is also possible to provide for a rigid connection between the drive lever and the rocker arm. It is only important that the basic adjustment, i.e., the slant of the rocker arm can be adjusted and that the point of action of the force can be varied.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
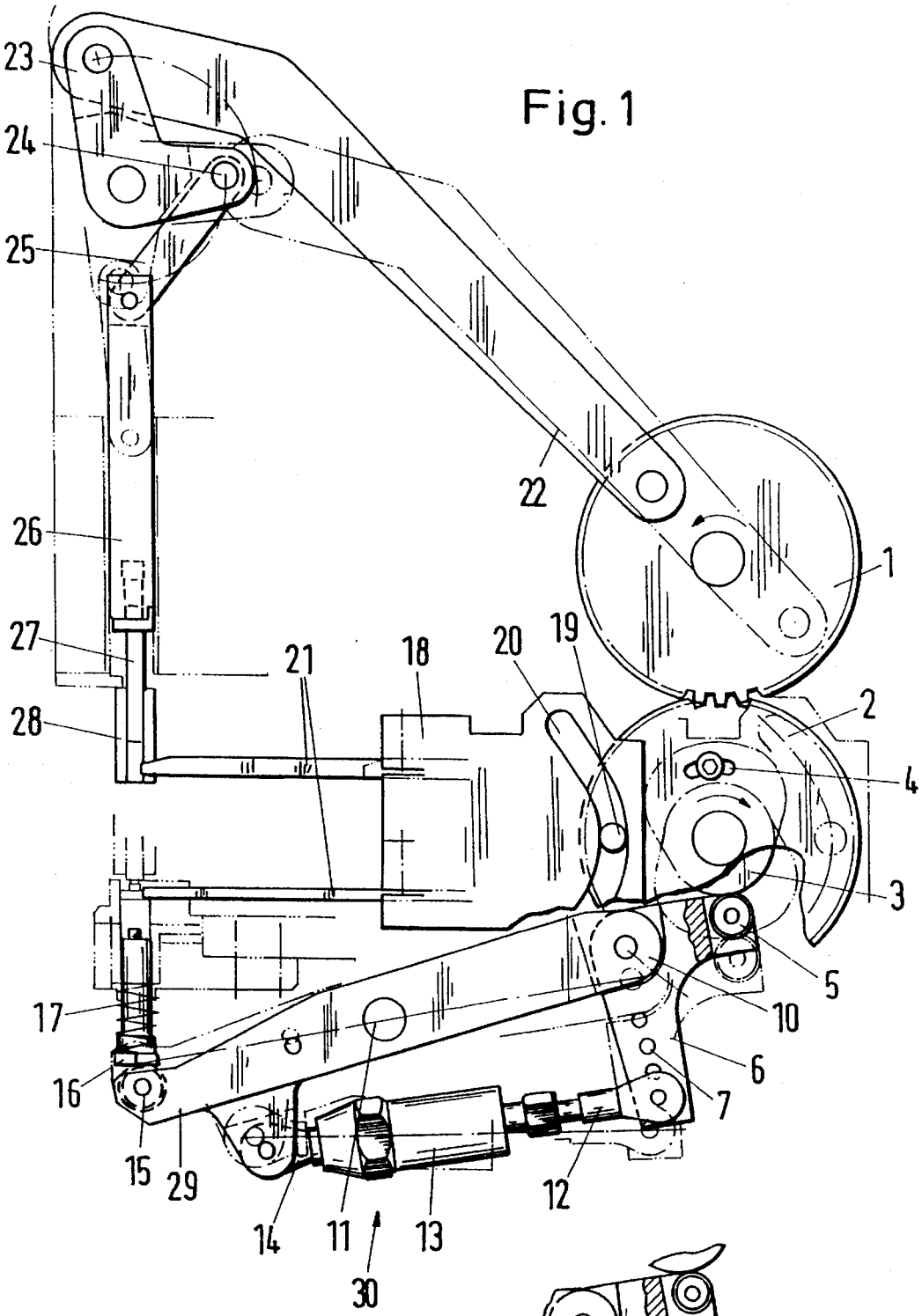
FIG. 1 shows a schematic representation of the inventive device.

The present invention will now be described in detail with the aid of several specific embodiments utilizing FIGS. 1 and 2.

The machine for mounting rivets, snap closures etc. comprises a drive disk 1 which is in gear connection with a push crank disk 2. An eccentric disk 3 is fixedly connected to the push crank disk 2 and is arranged on the same shaft. The connection between the eccentric disk 3 and the push crank disk 2 is accomplished with a connecting screw 4. The connecting screw 4 is arranged in a slotted hole provided in the push crank disk 2. With this arrangement the eccentric disk 3 can be adjusted with respect to the control time. The eccentric disk 3 cooperates with a roller 5 which is arranged at the drive lever 6. The drive lever 6 is provided with adjusting bores 7. With a pivoting joint 10 a rocker arm 29 is connected to the drive lever 6. The rocker arm is a two arm lever that can swivel about the swivel axis 11. A connecting eye 12 of a control rod 30 is connected to one of the adjusting bores 7 at the drive lever 6. The control rod 30 comprises an adjusting sleeve 13 and another connecting eye 14 at the opposite end which is connected to the rocker arm 29. The free end of the rocker arm 29 has arranged thereat a roller 15 that cooperates with the lower stamp 16. The lower stamp 16 is prestressed by a spring 17 and is reciprocated by the rocker arm 29.

The push crank disk 2 is connected to a carriage 18. For this purpose a roller 19, connected to the push crank disk 2, engages a guide slot 20 at the carriage 18. The guide slot 20 has a radius so that a resting time results in the rearward reversing position. During this period of time no advancing forces are exerted by the roller 19 onto the carriage 18 because the roller 19 simply rolls within the guide slot 20. Push rods 21 are arranged at the carriage 18 with which the articles (parts to be mounted) are fed to the tools (16, 27) at a defined point in time.

The crank rod 22 connected to the drive disk 1 actuates a lever 23 which is pivotable about an axis. The other end of the lever 23 is provided with a pivot joint 24 to which is connected a connecting lever 25. The other end of the connecting lever 25 has arranged thereat a push rod 26, and to the lower end of the push rod 26 the upper stamp 27 is attached. In the area of the upper stamp 27 a holding tool 28 is arranged.

The function of such a machine is known in general. In connection with the present invention it is important to realize that the control rod formed by the connecting eyes 12, 14 the threaded rod, and the adjusting sleeve 13 is longitudinally adjustable and that furthermore alternative points of attachment are provided at the drive lever 6 for the connecting eye 12. By selecting a respective adjusting bore 7 for attachment of the connecting eye 12, the point of action of the force can be varied.

Figure 2:
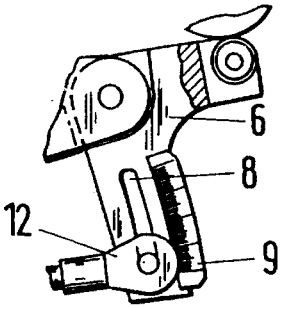
FIG. 2 shows a schematic representation of the drive lever area of the inventive device in an alternative embodiment.

In the alternative embodiment represented in FIG. 2 the drive lever 6 is provided with a longitudinal guide slot 8 adjacent to which an adjusting scale 9 is arranged. The connecting eye 12 can be fixed in any desired position, for example, with conventional bolt connections. Thus, a continuous adjustment of the point of action of the force is possible.

With the disclosed embodiments different material thicknesses and strengths can be taken into consideration during processing within the machine, and a pressure compensation as well as a stroke compensation can be realized.

The present invention is, of course, in no way restricted to the specific disclosure of the specification and drawings, but also encompasses any modifications within the scope of the appended claims.

What I claim is:

1. A device for mounting parts; said device comprising:

an upper tool with an upper stamp;

a lower tool with a lower stamp;

a drive unit for driving said upper and said lower tools;

a feeding device for feeding said parts to said upper and lower tools;

a gear arrangement for connecting said upper and said lower tools to said drive unit such that said upper and said lower tools are moveable in a reciprocating manner toward one another; and said gear arrangement comprising:

a) an eccentric disk;

b) a drive lever connected to said eccentric disk;

c) a rocker arm having a swivel axis about which said rocker arm swivels;

d) said rocker arm pivotably connected with a first end to said drive lever and with a second end to said lower tool; and e) a control rod connected to said rocker arm and said drive lever, wherein a plurality of points of attachment are provided for said control rod.

2. The device according to claim 1, wherein said attachment points are formed by bores at said drive lever.

3. The device according to claim 1, wherein said attachment points are formed by an elongate guide slot at said drive lever.

4. The device according to claim 3, wherein adjacent to said guide slot an adjusting scale is located.

5. The device according to claim 1, wherein said control rod has an adjustable length.

6. The device according to claim 5, wherein said control rod comprises a threaded rod and a threaded adjusting sleeve engaging said threaded rod.

* * * * *